United States Patent [19]

Irwin et al.

[11] 4,452,108

[45] Jun. 5, 1984

[54] RATCHETING PIPE WRENCH

[76] Inventors: Lawrence F. Irwin, 12860 San Fernando Rd., Sylmar, Calif. 91342; Robert Millray, 16036 Baker Canyon Rd., Saugus, Calif. 91350

[21] Appl. No.: 156,035

[22] Filed: Jun. 3, 1980

Related U.S. Application Data

[63] Continuation of Ser. No. 939,471, Sep. 5, 1978, abandoned.

[51] Int. Cl.[3] ..... B25B 13/12; B25B 13/28

[52] U.S. Cl. ..... 81/129; 81/96

[58] Field of Search ..... 81/96, 100, 129, 130 R, 81/133, 180 B, 186

[56] References Cited

U.S. PATENT DOCUMENTS

| | | | |
|---|---|---|---|
| 710,179 | 9/1902 | Burr | 81/96 |
| 1,593,588 | 7/1926 | Moore | 81/130 R X |
| 2,050,102 | 8/1936 | Kujala et al. | 81/100 |
| 2,594,684 | 4/1952 | Rothe | 81/180 B X |
| 2,714,321 | 8/1955 | Tamplin | 81/180 B X |
| 2,735,326 | 2/1956 | Morgan | 81/100 |

*Primary Examiner*—James G. Smith
*Attorney, Agent, or Firm*—James E. Brunton

[57] ABSTRACT

An improved ratcheting pipe wrench which includes a first toothed jaw formed on a first member and a second toothed jaw rotatably carried by a second member provided with an elongated handle portion. The first member has a shank portion which is slidably receivable in a guide way formed in the second member. The guide way is configured to provide clearance to the shank portion of the first member so as to permit both longitudinal and pivotal, or up and down rocking movement of the first member relative to the second member. With this construction the jaws of the wrench can readily be separated to accommodate a pipe, nut or bar (work piece) of various sizes. Further, with work piece in position between the toothed jaws, pressure exerted on the handle portion of the second member will tend to increasingly tighten the jaws about the work piece to provide a positive gripping action. Conversely, release of pressure on the handle portion will cause the jaws to loosen so that the wrench can readily be ratcheted to a new gripping position.

6 Claims, 10 Drawing Figures

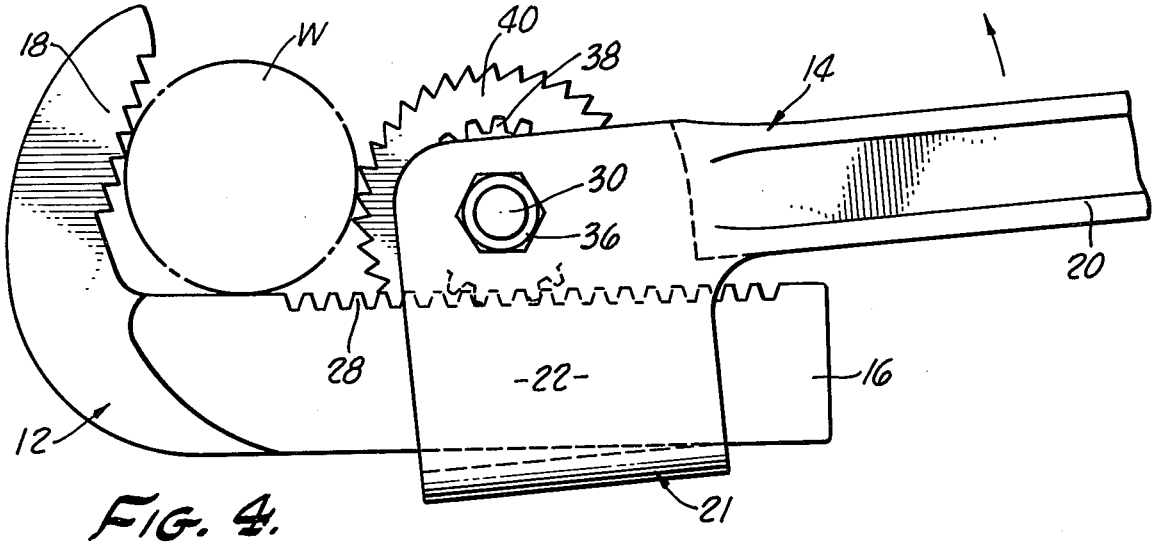
FIG. 4.
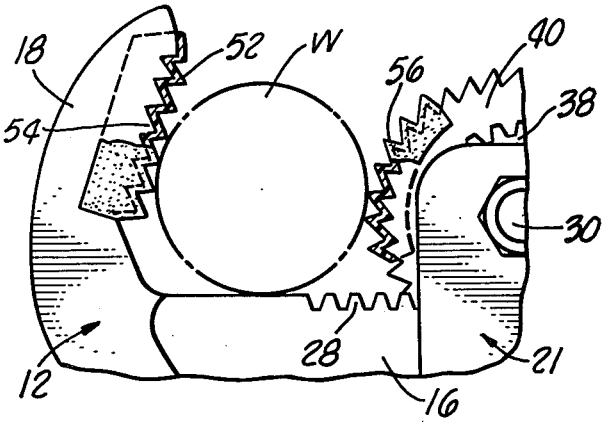
FIG. 5.
FIG. 7.
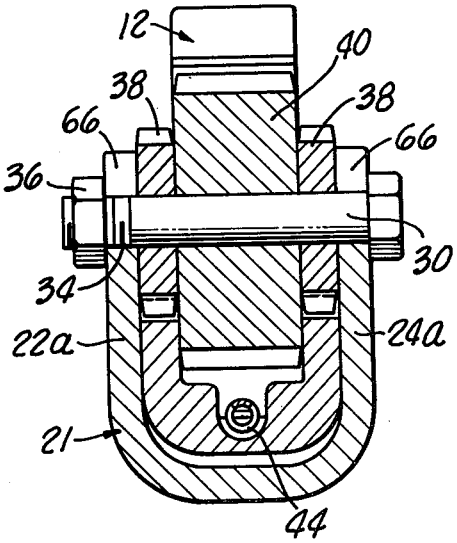
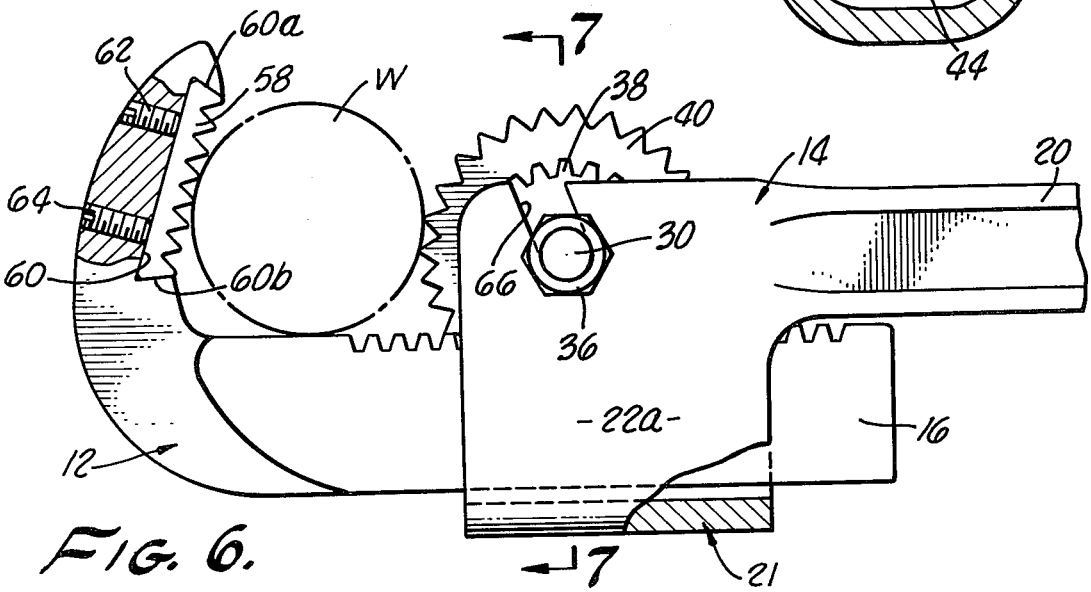
FIG. 6.

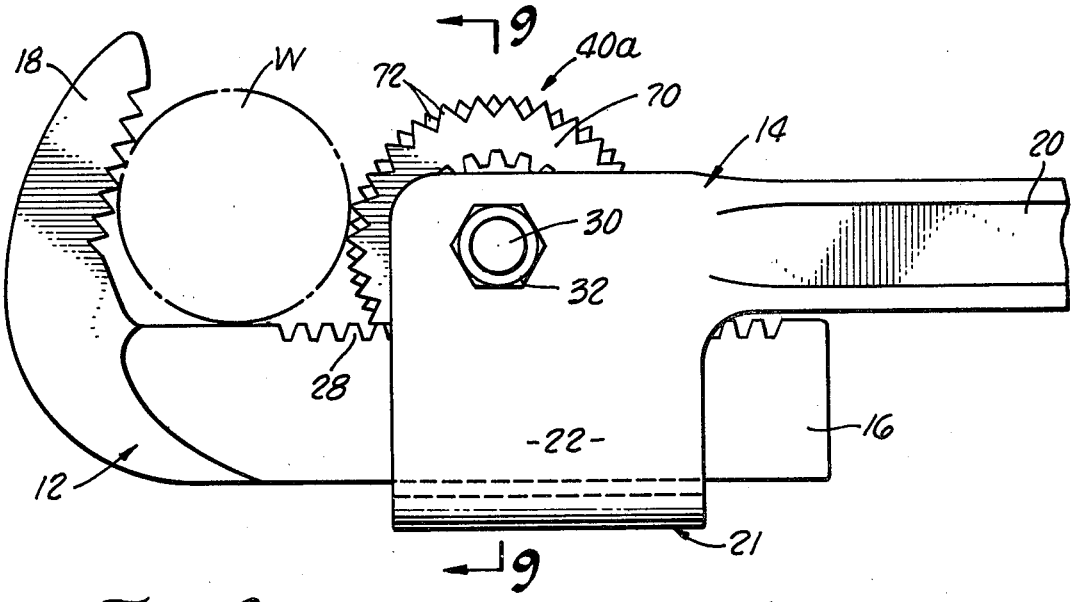
FIG. 8.
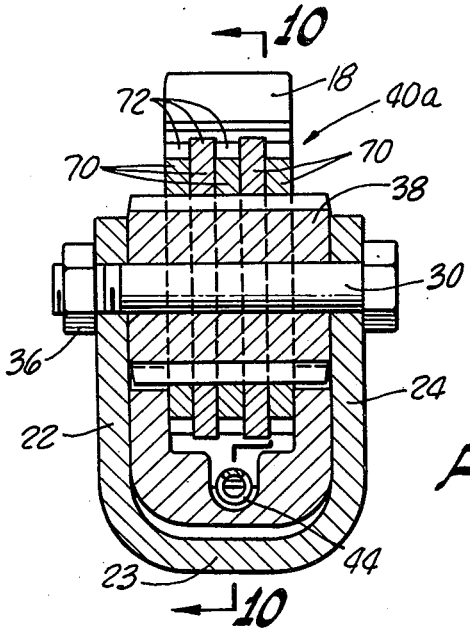
FIG. 9.
FIG. 10.
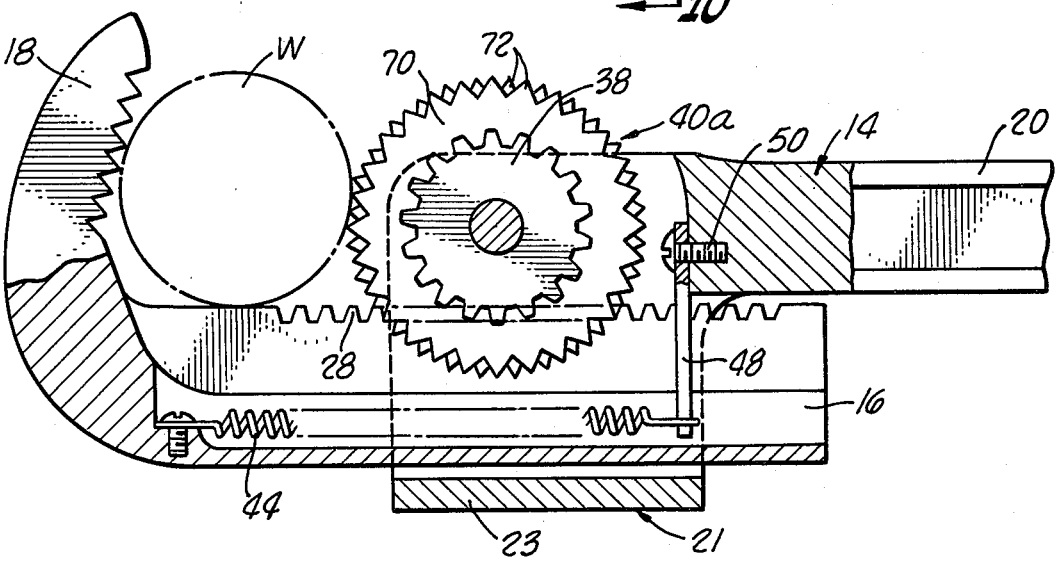

RATCHETING PIPE WRENCH

This is a continuation, of application Ser. No. 939,471 filed Sept. 5, 1978 now abandoned.

BACKGROUND OF THE INVENTION

1. Field of the Invention

The present invention relates generally to wrenches and more particularly to a ratcheting type pipe wrench having cooperating, relatively moveable pipe gripping jaws one of which is rotatable and the other of which is nonrotatable.

2. Discussion of the Prior Art

Pipe wrenches of various design have been suggested in the past including pipe wrenches having one fixed and one rotating type jaw. Wrenches of this type are disclosed in U.S. Pat. Nos. 1,195,558; 1,593,588; and 2,446,212.

Common to the prior art wrenches disclosed in the aforementioned patents and common to all wrenches of this general type of which the inventor is aware, is the provision of an elongated handle having a fixed jaw at its forward end and a reciprocating jaw adapted to move longitudinally of the handle. Frequently the handle is provided with a gear rack along which the reciprocating jaw rolls. The advantage of wrenches of this character over the traditional Stillson wrench is the ease of rapid adjustment of the jaws for initial engagement with different sizes of pipe. The drawback of such wrenches, however, resides in the fact that, while the rotating jaw is readily movable in a longitudinal direction relative to the fixed jaw, it is incapable of a pivotal or rocking type movement relative to the fixed jaw. This somewhat reduces the gripping effectiveness of the wrench since pressure on the handle will not tend to tighten the jaws about the work piece and, in fact, could cause loosening of the jaws. Additionally, since the movable jaw is typically biased toward the fixed jaw any ratcheting type action of the wrench is severely inhibited because a release of pressure on the handle will not automatically cause the jaws to loosen their grip upon the work piece. Further, the wrench must be manually adjusted to different sizes and will not ratchet on any shape other than a round pipe shape.

The wrench of the present invention effectively overcomes the drawbacks of the prior art designs by providing a wrench which, due to its unique configuration, accomodates longitudinal as well as rotational or pivotal degrees of movement of the gripping jaws relative to the work piece. the ability of the jaws to be readily separated longitudinally enables rapid and easy adjustment of the jaws for initial gripping of workpiece of widely differing diameters. The fact that the fixed jaw is formed on a part which is independently movable relative to the handle portion, however, permits relative pivotal or rocking movement of the jaws so that pressure exerted on the handle will tend to increasingly tighten the jaws about the work piece. Conversely, release of pressure on the handle will cause the jaws to automatically loosen their grip on the pipe so that the wrench can readily be ratcheted to a new gripping position.

In addition to the aforementioned patents, the following United States patents, believed pertinent to the invention clearly demonstrate the novelty of the wrench of the present invention: Nos. 710,179; 594,775; and 1,027,161.

SUMMARY OF THE INVENTION

It is an object of the present invention to provide an improved wrench for gripping cylindrical and spherical shaped work pieces in which the jaws can be quickly and easily spaced apart for initial engagement with objects of widely varying sizes.

A further, and highly important, object of the invention is to provide a wrench of the aforementioned character in which the jaws are uniquely configured and arranged so that pressure exerted on the handle of the wrench will tend to increasingly tighten the jaws about the work piece.

Another important object of the invention is to provide a wrench of the type described in the preceding paragraphs which is constructed so that a release of tightening pressure on the handle will tend to loosen the grip of the jaws on the work piece so that the wrench can readily be ratcheted to a new gripping position.

Another object of the invention is to provide a wrench of the character described in which the gripping jaws can be quickly and easily removed from the wrench and replaced with jaws having different gripping characeristics. For example, in using the wrench for rough work, jaws having steel teeth can be used. For work on fixtures or plated pipe, however, the steel jaws can readily be replaced with jaws having non-mar gripping teeth, or in the alternative, can be covered with inserts made of a non-mar material.

Still another object of the invention is to provide a wrench of the type described in the preceding paragraphs in which one of the jaws is rotatable and is reciprocally movable relative to the other jaw along tracks or other guide means. In this regard, a particular object of the invention is to provide a wrench of this type wherein the rotatable jaw is continuously urged toward the nonrotating jaw by biasing means and in which the rotating jaw comprises a plurality of relative rotatable discs having teeth formed about their peripheries. By staggering the transverse alignment of the teeth from disc to disc and by providing a slightly loose fit of these discs to the hub, a natural settling of the jaws individually to the most efficient grip of the work piece surface is achieved. This feature is particularly advatageous when the wrench is used on irregular shaped surfaces.

A further object of the invention is to provide a wrench of the class described which is rugged, requires little maintenance, is easy to use and can be manufactured at low cost.

BRIEF DESCRIPTION OF THE DRAWINGS

FIG. 4 is a side elevational view similar to FIG. 1 but showing the relative position of the parts of the wrench when a tightening force is exerted upon the handle portion in the direction indicated by the arrow.

FIG. 5 is a foreshortened side elevational view illustrating another form of the invention in which inserts constructed of a non-mar material are placed over the two jaws.

FIG. 6 is a foreshortened side elevational view of still another embodiment of the wrench of the invention in which the gripping jaws are replaceable.

FIG. 7 is a cross-sectional view taken along lines 7–7 of FIG. 6.

FIG. 8 is a side elevational view of another embodiment of the invention in which the rotating jaw is made up of a plurality of disc shaped elements.

FIG. 9 is a cross-sectional view taken along lines 9—9 of FIG. 8.

FIG. 10 is a foreshortened cross-sectional view taken along lines 10—10 of FIG. 9 illustrating the internal construction of the wrench of this form of the invention.

DESCRIPTION OF THE INVENTION

Figure 1:
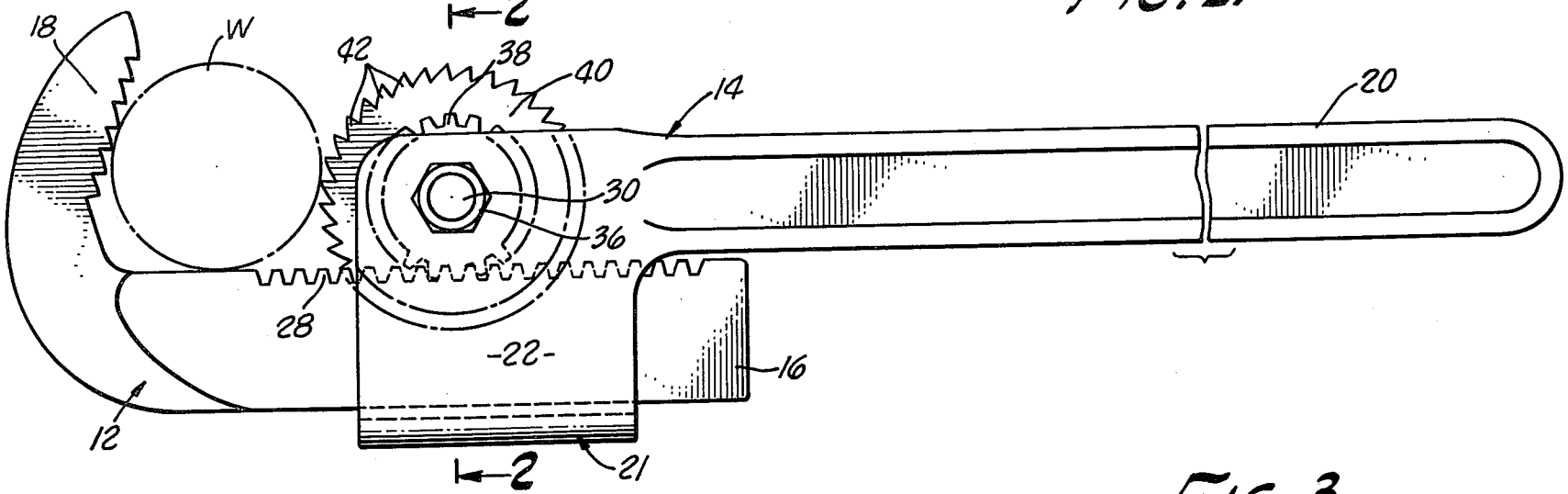
FIG. 1 is a side elevational view of one embodiment of the Ratcheting Wrench of the invention.
Figure 3:
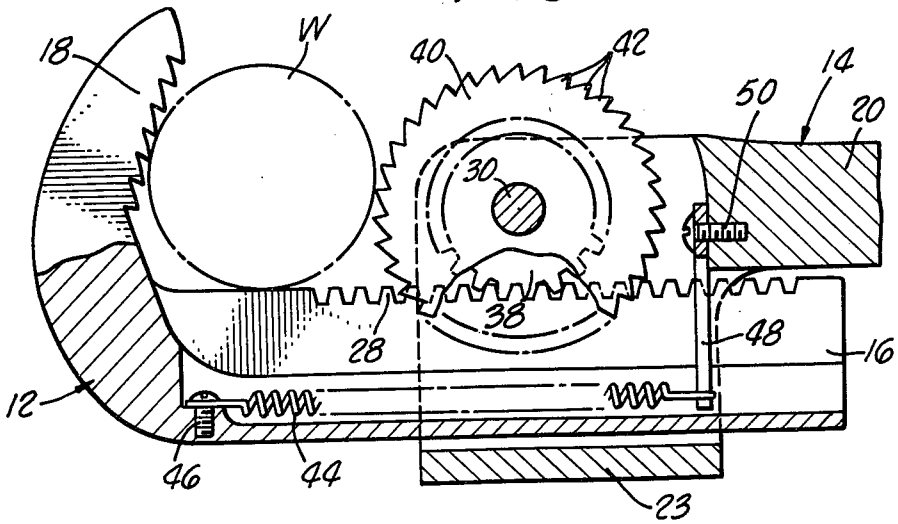
FIG. 3 is a foreshortened cross-sectional view taken along lines 3—3 of FIG. 2 showing the arrangement of the spring member adapted to bias the rotating jaw of the wrench in a direction toward the nonrotating jaw.
Figure 2:
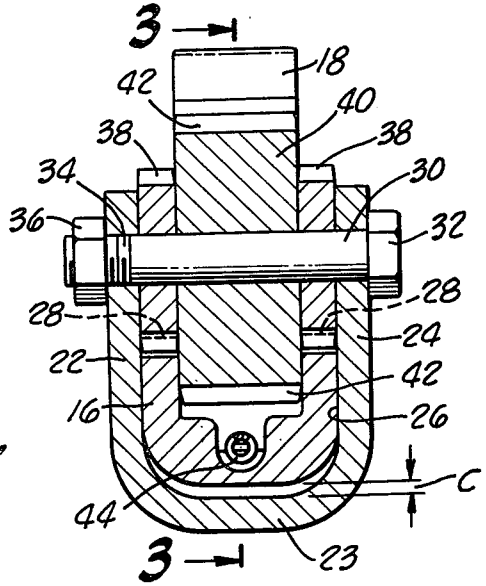
FIG. 2 is a cross-sectional view taken along lines 2—2 of FIG. 1.

Referring to the drawings, and particularly to FIGS. 1 through 3, the embodiment of the Ratcheting Wrench of the there shown invention can be seen to comprise relatively movable first and second members 12 and 14. First member 12 has a longitudinally extending shank portion 16 and is provided at its forward end with a first gripping means. In this form of the invention the first gripping means comprises a first work piece gripping means, or jaw, generally designated by the numeral 18. Second member 14 is provided with a rearwardly extending handle portion 20, and includes a forward portion 21 having spaced apart side walls 22 and 24 and an innerconnecting bight portion 23.

As best seen by referring to FIG. 2, shank portion 16 of member 12 is generally U-shaped in cross section and is adapted to be slidably received within a U-shaped channel or guideway 26 defined by the side walls and the bight portion of second member 14. Formed along the top edges of shank portion 16 are track means shown here in the form of spaced apart, longitudinally extending gear racks 28.

Side walls 22 and 24 of second member 14 are apertured to receive a threaded bolt 30 which has a head 32 and a threaded end portion 34. A nut 36 is threadably receivable over end 34 and holds bolt 30 in the position shown in the drawings. With this construction the shank portion of the bolt extends between side walls 22 and 24 and forms an axle member adapted to rotatably support roller means provided in the form of a pair of transversely spaced apart pinions 38. Pinions 38 comprise a part of a second gripping means of the invention and are adapted to mesh with gear rack 28.

Also rotatably carried by bolt 30 and forming a part of the second gripping means of the invention, is a second work piece gripping means, or jaw 40. Jaw 40, which is disposed intermediate pinions 38 and arranged coaxially therewith, is of a larger diameter than pinions 38 and is provided with a multiplicity of gripping teeth 42 located about its periphery. In the form of the invention shown in FIGS. 1 through 5 the teeth are saw tooth in shape. In the other embodiments shown in the drawings the teeth are substantially in the shape of equilateral triangles. It is to be understood, however, that, depending upon the work to be performed the teeth on both the rotating and nonrotating jaws can be formed in any desired shape.

As seen by also referring to FIG. 4, guide way 26 of member 14 is configured to permit both longitudinal and limited pivotal, or rocking movement of shank 16 therewithin. With this arrangement, when the work piece W is positioned between the first and second jaws, forces exerted on handle 20 in the direction of the arrow in FIG. 4 will tend to increasingly tighten the gripping jaws about the work piece W. By varying the clearance C (FIG. 2) between the shank portion 16 of the first member and the bight portion 23 of the second member, the degree of rocking or rotational movement of shank 14 within channel 26 can be regulated. The degree of rocking movement in turn governs the extent to which the jaws 16 and 40 will tend to grip the work piece in response to tightening forces exerted on handle 20. An important feature of the invention resides in the fact that, because of clearance C, when tightening pressure against handle 20 is discontinued the gripping jaws will automatically release their grip on the work piece. It is this release of the gripping forces on the work piece which allows the wrench to be readily ratcheted to a second gripping position.

Referring now to FIG. 3, the wrench of this embodiment of the invention also includes biasing means for yieldably urging jaw 18 toward rotating jaw 40. In this form of the invention, the biasing means comprises an elongated coiled spring 44 connected at one end to member 12 by a fastener 46 and connected at its opposite end to a depending member 48 which in turn is connected to handle 20 by a fastener 50. Exertion of a force tending to separate the cooperating jaws sufficient to overcome the urging of spring 44 permits work pieces of widely varying sizes to be readily inserted between the jaws. During separation of the jaws pinions 40 will roll along racks 28 assuring smooth longitudinal movement between the cooperating members 12 and 14.

Turning now to FIG. 5 of the drawings, another embodiment of the Ratcheting Wrench of the present invention is there illustrated. The form of the invention shown in FIG. 5 is substantially identical to the form of the invention shown in FIGS. 1 through 4 and the component parts thereof are similarly numbered. In this form of the invention, however, jaw 18 of member 12 is adapted to receive a work piece gripping overlay or insert generally designated by the numeral 52. This overlay may be press-fit over teeth 54 formed in member 12 or may be appropriately held in position by set screws or other types of fasteners. Overlay or insert 52 may be formed of a hard or soft metal or of a composite material depending upon the character of the work to be performed.

In those instances when rotating jaw 40 is formed of a hard material, such as hardened steel, it is often desirable to cover the teeth on both the fixed and rotating jaws with a non-mar material, so that when the wrench is used on fixtures of chrome plated pipe, the teeth will not mar the work piece. In the form of the invention shown in FIG. 5, non-mar insert 56, adapted to cover the teeth of jaw 40, is constructed of a material such as plastic, a soft metal, a fibrous composite or the like and is formed so as to be closely received over the teeth of the rotating jaw. Upon completion of the work on the fixture or plated pipe, the inserts 52 and 56 may be conveniently removed from the working jaws so that the wrench can once again be effectively used for rough plumbing work wherein it is desirable that the teeth of the jaws actually bite into the work piece.

Turning now to FIGS. 6 and 7, still another form of the Ratcheting Wrench of the invention is illustrated. This embodiment of the invention is similar in construction and operation to the embodiment previously discussed and comparable elements thereof bear numbers which correspond to those previously used to identify the parts of the apparatus. In contradiction to the embodiment of the invention shown in FIG. 5, in the form of the invention shown in FIG. 6, the nonrotating jaw is provided in the form of a work piece gripping insert 58 which is held in position in a groove 60 formed in member 12. Groove 60, however, is formed with tapered sides 60*a* and 60*b* and the insert 58 is held in position within member 12 by set screws 62 and 64. Insert 58, which may be formed of any suitable material, either harder or softer than the material from which member 21 is constructed, is closely received within slot 60 and is securely held in position by the set screws 62 and 64.

An important feature of the embodiment of the invention shown in FIGS. 6 and 7 is the removability of the rotating jaw 40. As best seen by referring to FIG. 6, the side walls 22*a* and 24*a* of forward portion 21 of member 14 are provided with forewardly sloping slots, or passageways 66. Slots 66 are adapted to closely receive the shank portion of bolt 30 so that the rotating wheel, along with pinions 38, can readily be removed from member 14 and replaced with a rotatable jaw 40 having different material characteristics or tooth design as may be required for the particular work piece upon which the wrench is being used. Removal of the rotatable jaw 14 is easily accomplished by simply loosening nut 36, lifting the assemblage upwardly and forwardly of the wrench. A new assemblage can be quickly inserted into slot 66 and secured within the wrench by tightening nut 36. In similar fashion, inserts 58 may be easily removed from the nonrotating jaw by simply loosening set screws 62 and 64 and sliding the inserts in a lateral direction out of the tapered groove. With the construction thus described, the basic wrench along with three or four replacement jaws constructed of materials of various hardness can be used to accomplish virtually every type of plumbing work which may be required from rough plumbing to work on the finest of fixtures.

Referring now to FIGS. 8 through 10, yet another form of Ratcheting Wrench of the present invention is there illustrated. In this form of the invention, members 12 and 14 are of identical construction to that shown and described in FIGS. 1 through 3. The important feature of this embodiment of the invention resides in the unique construction of the ratating jaw designated in FIGS. 8 through 10 by the numeral 40*a*. Rotating jaw 40*a*, rather than being formed as a single drum shaped element, comprises a plurality of rotatable discs 70 each of which has gripping teeth 72 formed about its periphery. Discs 70 can be formed of any suitable material and can be stamped from a planar sheet of material thereby significantly reducing manufacturing costs.

Each disc 70 as well as each of the pinions 38 is rotatably carried by the shank portion of bolt 30. Preferably, discs 70 are adapted to fit somewhat loosely over pinions 38. This slight looseness permits individual movement of each disc relative to the pinions so that the teeth can accomodate adjacent high and low areas on the work piece and can "settle" to the most effective gripping of the particular surface shape. As was the case in the embodiments of the invention previously described pinions 38 are adapted to roll along tracks 28 formed on member 12, and the gripping jaws 18 and 40*a* are continuously urged toward one another by a biasing means provided in the form of a spring 44.

As best seen by referring to FIG. 10, discs 70 are preferably staggered so that the teeth 72 formed thereon are maintained out of alignment transversely of the wrench. This construction enables superior gripping of work pieces, particularly work pieces having irregularities in their exterior surfaces. Additionally, for certain applications, discs 40 may be permitted to rotate realtive to one another so that teeth 42*a* will be able to "seek out" gripping surfaces on the work piece. This arrangement has proved highly successful in performing operations on pipe which may be deformed so that it has high and low spots along its exterior surfaces. The ability of discs 70 to rotate relative to one another enables the teeth 42*a* to seek out and engage high and low surfaces as the handle 20 is rotated in a tightening direction enabling relative rocking movement between members 12 and 14. For certain applications, discs 70 may be keyed to the shank of bolt 30 so as to orient the discs relative to one another and limit the degree of relative rotation thereof about the shank portion of bolt 30. The degree of relative rotation among discs 70 may also be controlled by tightening and loosening nut 36.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A ratcheting wrench for gripping cylindrical work pieces comprising:

(a) a first member having a forward portion comprising a first work piece gripping jaw and a shank portion provided with a pair of transversely spaced apart racks arranged longitudinally of said shank;

(b) a second member comprising a rearwardly extending handle portion and a forward portion having spaced apart walls defining a longitudinally extending guide way adapted to slidably receive said first member;

(c) a pair of transversely spaced apart pinions rotatably carried by said second member and adapted to mesh with said rack of said first member;

(d) a second work gripping jaw rotatably carried by said second member and disposed intermediate said pinions, said second jaw being arranged coaxially with said pinions and being of larger diameter, said channel of said second member being configured to permit both longitudinal and limited pivotal movement of said first work gripping jaw relative to said second work gripping jaw whereby with the work piece positioned between said jaws, forces exerted on said handle portion tending to rotate said work piece in a tightening direction will cause said relative jaws to tighten about said work piece said second work gripping jaw being adapted to grip uneven surfaces and being freely rotatable relative to said work piece upon the release of said forces on said handle portion whereby the wrench can be freely ratcheted into a second gripping position upon exertion of forces on said handle in a loosening direction; and (e) means for yeildably urging said first work gripping jaw longitudinally toward said second work gripping jaw.

2. A ratcheting wrench for gripping a work piece, comprising:

(a) a first member having a first gripping means and a longitudinally extending shank portion;

(b) a second member comprising a rearwardly extending handle portion and a forward portion having guide means adapted to receive said shank of said first member, said guide means being adapted to guide longitudinal movement of said first member relative to said second member and being configured to permit rocking movement of said shank of said first member with respect to said second member in response to tightening forces exerted on said handle portion;

(c) a second gripping menas comprising a work piece engaging means rotatably carried by said second member, said work piece engaging means comprising an axle and a plurality of discs rotatable about said axle each said disc having gripping teeth formed about its periphery and each being rotatable relative to the disc adjacent thereto and each being movable radially relative to said axle, said second gripping means being adapted to be moved into gripping engagement with said work piece in response to said tightening forces and being adapted to move out of gripping engagement with said work piece upon the release of said forces whereby said wrench can be rotated relative to said work piece; and (d) biasing means for yieldably urging movement of said first and second gripping means toward one another.

3. A freely ratchetable wrench for releasably gripping a work piece, comprising:

(a) a first member having a shank portion provided with longitudinally extending track means, said first member terminating at its forward end in a first gripping means;

(b) a second member comprising a rearwardly extending handle portion and a forward portion having a guide way adapted to slidably receive said shank of said first member, said guide way being configured to permit rocking movement of said shank therewithin in response to forces exerted on said handle portion tending to rotate said work piece; and (c) a second gripping means comprising a work piece engaging means rotatably carried by said second member and including roller means adapted to roll along said track means of said first member, said second gripping means being adapted to grip uneven surfaces and being freely rotatable relative to said work piece upon the release of forces exerted on said handle portion tending to rotate said work piece, whereby said wrench may be freely ratcheted into a second gripping position by counter rotation of said handle, said work piece engaging means comprising a plurality of rotatable discs each said disc having gripping teeth formed about its periphery, each of said discs being both rotatable and radially movable with respect to its adjacent discs whereby said work piece engaging means can accommodate uneven and variously configured work piece surfaces.

4. A ratcheting wrench as defined in claim 3 in which said biasing means comprises an elongated spring one end of which is interconnected with said first member and the other end of which is interconnected with said second member.

5. A ratcheting wrench as defined in claim 3 in which said track means comprises a pair of transversely spaced apart racks and in which said roller means comprises a pair of transversely spaced apart pinions adapted to mesh with said racks, said rotatable discs being disposed intermediate said pinions.

6. A ratcheting wrench as defined in claim 5 in which said rotatable discs are independently rotatable relative to said pinions whereby said gripping teeth of said discs can accommodate adjacent high and low areas on said work piece.

* * * * *